US006015332A

United States Patent [19]

Lee et al.

[11] Patent Number: 6,015,332

[45] Date of Patent: Jan. 18, 2000

[54] PUSH-UP BRA PAD

[75] Inventors: Chih-Jung Lee; Judy Lee, both of Monterey Park, Calif.

[73] Assignee: Ce Soir Lingerie Co., Inc., Ventura, Calif.

[21] Appl. No.: 09/132,572

[22] Filed: Aug. 11, 1998

[51] Int. Cl.[7] ..... A41C 3/10

[52] U.S. Cl. ..... 450/57; 450/38; 623/8

[58] Field of Search ..... 450/38, 57, 30–35, 450/53; 623/7, 8; 607/104–108

[56] References Cited

U.S. PATENT DOCUMENTS

| | | | |
|---|---|---|---|
| 4,024,876 | 5/1977 | Penrock | 450/48 |
| 4,731,081 | 3/1988 | Tiffany et al. | 623/8 |
| 4,820,303 | 4/1989 | Brauman | 623/8 |
| 5,411,554 | 5/1995 | Scopelianos et al. | 623/8 |
| 5,676,698 | 10/1997 | Janzen et al. | 623/8 |

*Primary Examiner*—Gloria M. Hale
*Attorney, Agent, or Firm*—Marvin E. Jacobs

[57] ABSTRACT

A push-up bra has an envelope between the front panel and the rear panel of the bra cups, that receives a flexible pouch containing a mixture of water and a hygroscopic agent such as 70% glycerine—30% water. The hygroscopic agent will draw moisture into the envelope preventing the volume of liquid from decreasing.

12 Claims, 2 Drawing Sheets

PUSH-UP BRA PAD

TECHNICAL FIELD

The present invention relates to an improved pad for a brassiere and, more particularly to a flexible, liquid filled envelope incorporated into a push-up bra.

BACKGROUND OF THE INVENTION

Brassieres are worn not only to provide support for women's breasts, but also to enhance the shape of the breasts within the brassieres, the portion of the breasts above the breasts and the cleavage between the breasts.

Push-up bras are designed to shape and elevate the breasts. Push-up bras usually contain a rubber pad received in a pocket in the lower front panels of the bra cups. The pad was formed by molding into a complex arcuate shape. Rubber pads were both stiff and uncomfortable. Rubber pads also caused insecurity due to straying of the pads. Other push-up bras used a more yielding silicone foam and some use Nylon (polyamide) padding to shape and lift.

Push-up bras with liquid filled envelopes have recently appeared on the market. Silicone oil liquids are very expensive and are hard to seal. Hydrocarbon oils have also been utilized as the liquid either alone or in a mixture with water. Hydrocarbons can attack the envelope. The liquids in the envelope are heated to body temperature of about 99° F. At this temperature, evaporation is increased and the hydrocarbon vapors can permeate through the wall of the envelope, creating offensive, unpleasant odors. Furthermore, water vapor is also able to permeate through the wall of the envelope decreasing the liquid volume in the envelope. The envelope could rupture or impact or when pierced by a sharp object causing embarrassment, discomfort and destruction of the pad.

List of References

| Patentee | Patent No. |
|---|---|
| Block, et al. | 3,620,222 |
| Kirby, et al. | 3,845,507 |
| Miller | 5,235,974 |

STATEMENT OF THE PRIOR ART

Block, et al. discloses a foam, push-up brassiere pad. Kirby, et al. discloses a breast prosthesis to be worn inside a brassiere cup containing an inner bag. A jell-like liquid such as carboxymethyl cellulose is sealed within an outer bag containing air. Miller discloses an electrically heated bra for lactating mothers containing a fluid impermeable chamber filled with water.

STATEMENT OF THE INVENTION

The improved bra according to the invention contains a flexible envelope filled with a mixture of water and an odorless, organic hygroscopic agent in specified proportions providing no unpleasant aroma and little evaporation of water through the film of the envelope. The envelope is formed of a film of a tough synthetic resin resistant to puncture, preferably a thermoplastic resin capable of being heat-sealed. The film has low transmission rate for water vapor. The hygroscopic agent is able to drive water vapor from outside the envelope through the film into the envelope so that liquid volume is maintained.

The push-up bra of the invention looks and feels more natural and the bra eliminates discomfort and insecurity caused by stiff, sharp edged or straying inner pads. The inner cup lining adjacent the skin is soft and wicks moisture away from the skin.

These and many other features and attendant advantages of the invention will become apparent as the invention becomes better understood by reference to the following detailed description when considered in conjunction with the accompanying drawings.

DETAILED DESCRIPTION OF THE INVENTION

Figures 1, 2:
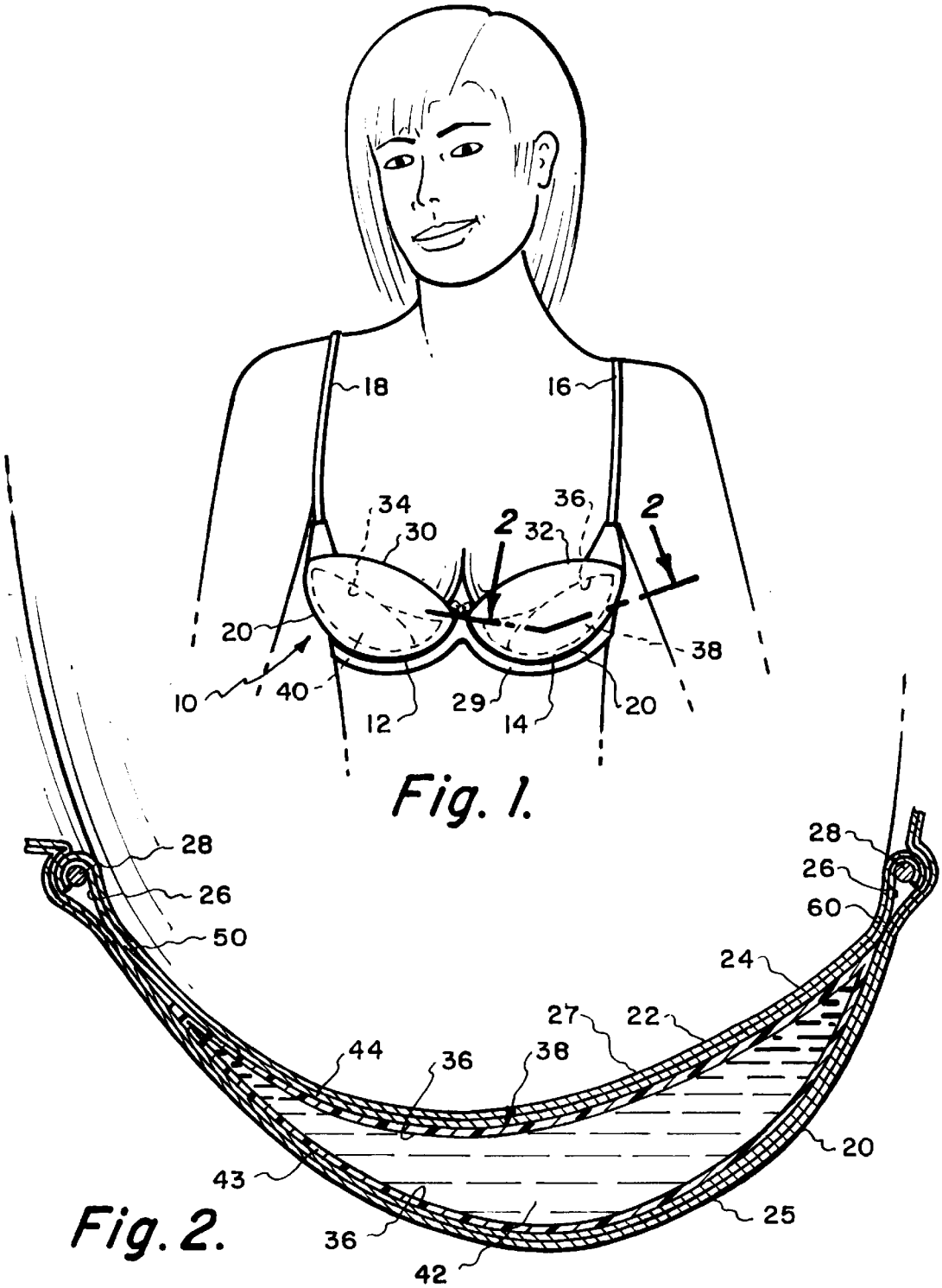
FIG. 1 is front view in elevation illustrating the push-up bra of the invention.
FIG. 2 is a view in section taken along line 2—2 of FIG. 1.
Figure 3:
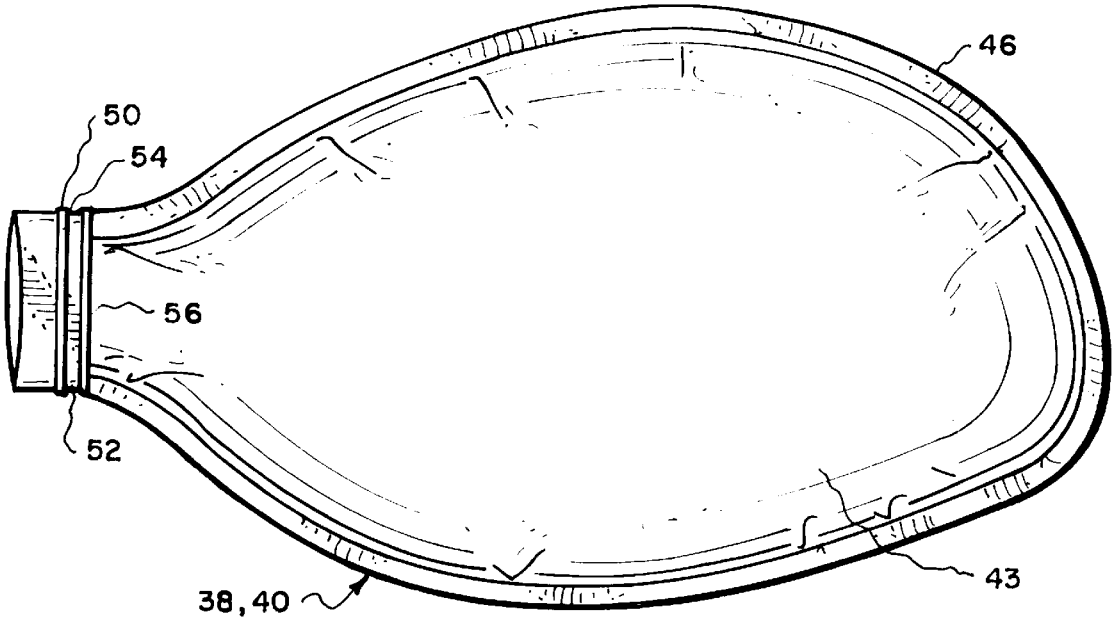
FIG. 3 is a side view in elevation of a bra pad envelope.

Referring now to FIGS. 1 and 2, the push-up bra 10 of the invention is formed of two cups 12, 14, a stretchable strap with releasable fastener, not shown, and optional shoulder straps 16, 18.

The cups 12, 14 are formed of an outer layer 20 of fabric and an inner layer 22 of fabric. The outer layer 20 of fabric can be covered with a layer 25 of decorative material such as lace. The surface 24 of the inner layer 22 is preferably covered with a layer of a soft material 27 which absorbs and wicks moisture such as woven cotton or polypropylene cloth. A long narrow sleeve 26 following the curved outline of the bra cup can be formed along the lower periphery 29 of the bra cups 12, 14. A curved metal stiffening rod 28 is received in the sleeve 20 and inner layers 22 of each cup 12, 14.

The outer layers are stitched around their common peripheries 30, 32 to form pockets 34, 36 for receiving a flexible pouch 38, 40 containing a liquid 42 as shown in FIG. 2. The pouches 36, 40 have the general exterior shape of a bra cup 12, 14. The pouches 38, 40 are formed of a front film 42 heat sealed to a rear panel 44 forming a lip 46. The pouches 38, 40 are preferably anchored to the outer layer 20 or inner layer 22 of fabric. The lip 46 could be formed by adhering the outer peripheries of the two panels by adhesive or stitching. However, stitching or adhesive could make the lip 46 more susceptible to tear. It is preferred that the pouches 38, 40 be provided with an extended tab 50 which before thermal bonding serves as a filling spout.

The two layers 20, 22 of the pouch are completely thermal sealed within the tab 50 into a unitary film 52. Two thermally generated beads 54, 56 can be provided normal to the axis of the pouches to reinforce the tab from tearing.

The tab 50 is sewn 60 into the edge of the outer layer of fabric 20 near the outside periphery of the pocket 34, 36. The pouch 38, 40 is then inserted into the pockets 34, 36. The edge of the inner layer 22 of fabric is then stitched to the edge of the outer layer 20.

The skin of the pouch is a tough, puncture-resistant, flexible film such as a 0.01 to 5 mm thick film, preferably a film having a thickness from 0.05 to 0.5 mm. Suitable films are thermoplastic, thermally bondable films such as polyethylene, vinyl, silicone resins or polyurethane which can be in the form of a closed cell foam. The surface of the pouch has good wetability for water is resistant to hydrolysis, has flame retardence, U.V. It is stable to being agitated with hot soapy water in a washing machine. The film can have a Shore A Hardness from 50 to 100, a Specific Gravity of 1.1 to 1.3 an elongation of at least 300% and a minimum tear strength of 200 Lb/in. The film should have a high melting temperature above 180° C. in order to be capable of surviving temperatures encountered in washing and drying machines. However, hand washing and air drying of the bra are preferred.

The pouches are filled with a mixture of water and a major amount of an organic, hygroscopic material miscible with water. The mixture of water and the hygroscopic material forms a clear, uniform liquid having a viscosity similar to water. The organic hygroscopic materials are polyhydric organic compounds containing a plurality of hydroxyl group such as glycerine (glycerol) or liquid polyols. Glycerine is preferred since it is a clear, colorless, odorless syrupy liquid having hygroscopic properties. A USP grade having minimum purity of 99.5% is preferred.

Analysis of a USP glycerine used in the push-up bra of the invention follows:

| TEST | RESULT | SPECIFICATION |
|---|---|---|
| Glycerine Content % | 99.68 | 99.5 min. |
| Relative Density 25/25 | 1.2609 | 1.2607 min. |
| Color Apha | 5 | 10 max. |
| Ash | <0.01 | 0.01 max. |
| Chloride ppm | <10 | 10 max. |
| Sulphate ppm | <20 | 20 max. |
| Arsenic ppm | <1.5 | 1.5 max. |
| Heavy Metal ppm | <5 | 5 max. |
| Chlorinated Compounds ppm | <30 | 30 max. |
| Fatty Acid & Esters ml 0.5 NAOH | 0.7 | 1.0 max. |

A prototype of the push-up bra of the invention was prepared by filling a polyurethane pouch with a mixture of 30% water and 70% USP glycerine. The tab on the pouch was heat sealed and then inserted into a pocket in a push-up bra. The tab was sewn into the periphery of the pouch and the seam on the inner layer of fabric was closed.

The film was a closed cell polyurethane having the following properties:

| Properties | |
|---|---|
| Color APHA | 5 |
| Thickness | 0.1 mm |
| Hardness | 87 Shore A |
| Specific Gravity | 1.20 |
| Tensile Strength | 6525 psi |
| Elongation | 480% |
| Tear Strength | 400 lb/in |
| Melting Temperature | 180–190° C. |

The prototype was tested under normal wearing conditions. The mixture of water and glycerine provided a natural cushion. The pouch did not leak or ooze liquid. It was self sealing. There was no loss of volume over a 3 month test period due to permeation of water due to the glycerine humectant within the pouch. The bra was very comfortable for a shaping bra and gave a natural lift for a fuller look. Though the bra can be machine washed, there is less wear and tear if the bra is hand washed and hung to dry.

It is to be realized that only preferred embodiments of the invention have been described and that numerous substitutions, modifications and alterations are permissible without departing from the spirit and scope of the invention as defined in the following claims.

What it is claim:

1. A pad for a push-up bra comprising a flexible, sealed envelope formed of a film of tough, synthetic resin, resistant to puncture capable of permeation of water through the film at body temperature, said envelope containing a liquid consisting essentially of a mixture of 10–60% by weight water; the remainder being an organic hygroscopic agent miscible with water capable of drawing water vapor from outside the envelope through the film into the envelope.

2. A pad according to claim 1 in which the film has a low transmission rate for water vapor.

3. A pad according to claim 2 in which the organic hygroscopic agent is present in said liquid in a major amount.

4. A pad according to claim 2 in which the hygroscopic agent is an organic polyhydric alcohol.

5. A pad according to claim 4 in which the polyhydric alcohol is glycerine.

6. A pad according to claim 5 in which the liquid contains about 30% water and about 70% glycerine.

7. A pad according to claim 1 in which the envelope is formed of a heat sealable, flexible, tear-resistant film having a thickness from 0.01 to 5 mm.

8. A push-up bra cup comprising in combination:

a front fabric panel in the shape of a bra cup and having a peripheral edge;

an inner fabric panel in the shape of a bra cup having a peripheral edge;

the peripheral edges being joined to form an envelope; and a flexible pouch formed of a flexible film of organic resin capable of permeation of water through the film at body temperature, said pouch containing an odorless liquid consisting essentially of a mixture of water and a major amount of an organic hygroscopic agent capable of drawing water vapor from outside said pouch through said film into said pouch, said pouch being received in the envelope.

9. A push-up bra according to claim 8 in which the odorless liquid contains at least 50 to 90% by weight of a polyhydric alcohol hygroscopic agent.

10. A push-up bra according to claim 9 in which the odorless liquid is a mixture of about 30% by weight of water and 70% by weight of glycerine hygroscopic agent.

11. A push-up bra containing:

two bra cups;

means joining the cups;

a strap connecting the cups;

said cups each containing a flexible pouch formed of a film of synthetic organic resin capable of transmitting water vapor through the film at body temperature, said pouch containing a mixture of water and a major amount of an organic polyol hygroscopic material capable of drawing water vapor through said film into said pouch.

12. A bra according to claim 11 in which the material is glycerine.

* * * * *